US005745079A

United States Patent [19]

Wang et al.

[11] Patent Number: 5,745,079

[45] Date of Patent: Apr. 28, 1998

[54] WIDE-BAND/DUAL-BAND STACKED-DISC RADIATORS ON STACKED-DIELECTRIC POSTS PHASED ARRAY ANTENNA

[75] Inventors: Allen T.S. Wang, Buena Park; Kuan M. Lee, Brea; Ruey S. Chu, Cerritos, all of Calif.

[73] Assignee: Raytheon Company, Lexington, Mass.

[21] Appl. No.: 678,383

[22] Filed: Jun. 28, 1996

[51] Int. Cl.[6] ..... H01Q 1/38; H01Q 1/48

[52] U.S. Cl. ..... 343/700 MS; 343/846

[58] Field of Search ..... 343/700 MS, 829, 343/846, 830; H01Q 1/38, 1/48

[56] References Cited

U.S. PATENT DOCUMENTS

| | | | |
|---|---|---|---|
| 4,477,813 | 10/1984 | Weiss | 343/700 MS |
| 4,623,893 | 11/1986 | Sabban | 343/700 MS |
| 4,835,538 | 5/1989 | McKenna et al. | 343/700 MS |
| 5,006,854 | 4/1991 | Wong et al. | 343/700 MS |
| 5,010,348 | 4/1991 | Rene et al. | 343/700 MS |
| 5,243,353 | 9/1993 | Nakahara et al. | 343/700 MS |
| 5,382,959 | 1/1995 | Pett et al. | 343/700 MS |
| 5,434,581 | 7/1995 | Raguenet et al. | 343/700 MS |

FOREIGN PATENT DOCUMENTS

| | | | |
|---|---|---|---|
| 2046530 | 11/1980 | United Kingdom | 343/700 MS |

OTHER PUBLICATIONS

Microstrip Array Technology, Robert J. Mailloux et al., IEEE Antennas and Propagation Transactions, vol. AP-29, Jan. 1981, pp. 25-37.

*Primary Examiner*—Hoanganh T. Le

*Attorney, Agent, or Firm*—Leonard A. Alkov; Glenn H. Lenzen, Jr.

[57] ABSTRACT

A very wide-band or dual-band phased array antenna using stacked-disc radiators on stacked-dielectric cylindrical posts to form radiator elements. Each radiator element includes a ground plane, a lower dielectric cylindrical post of a high dielectric material adjacent the ground plane, a lower thin conductive radiator disc formed on the upper surface of the lower dielectric post, an upper dielectric cylindrical post of a low dielectric material disposed on top of the lower post and lower radiator disc, and an upper thin radiator disc or annular ring formed on the upper surface of the upper post. The first radiator disc is excited by two pairs of probes arranged in orthogonal locations. Each pair of probes can be fed by coaxial cables with 180 degree phase reversal. The second radiator disc or annular ring is a parasitic radiator without feeding probes. Depending on the feed arrangement, the radiator elements can achieve single-linear polarization, dual-linear polarization or circular polarization.

11 Claims, 6 Drawing Sheets

FIG. 6
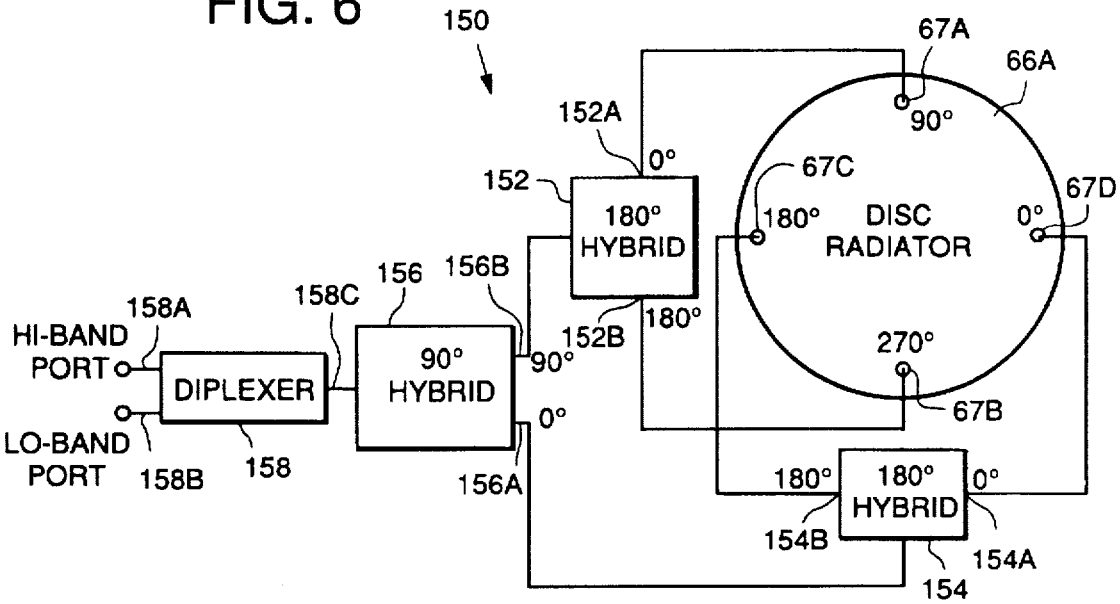
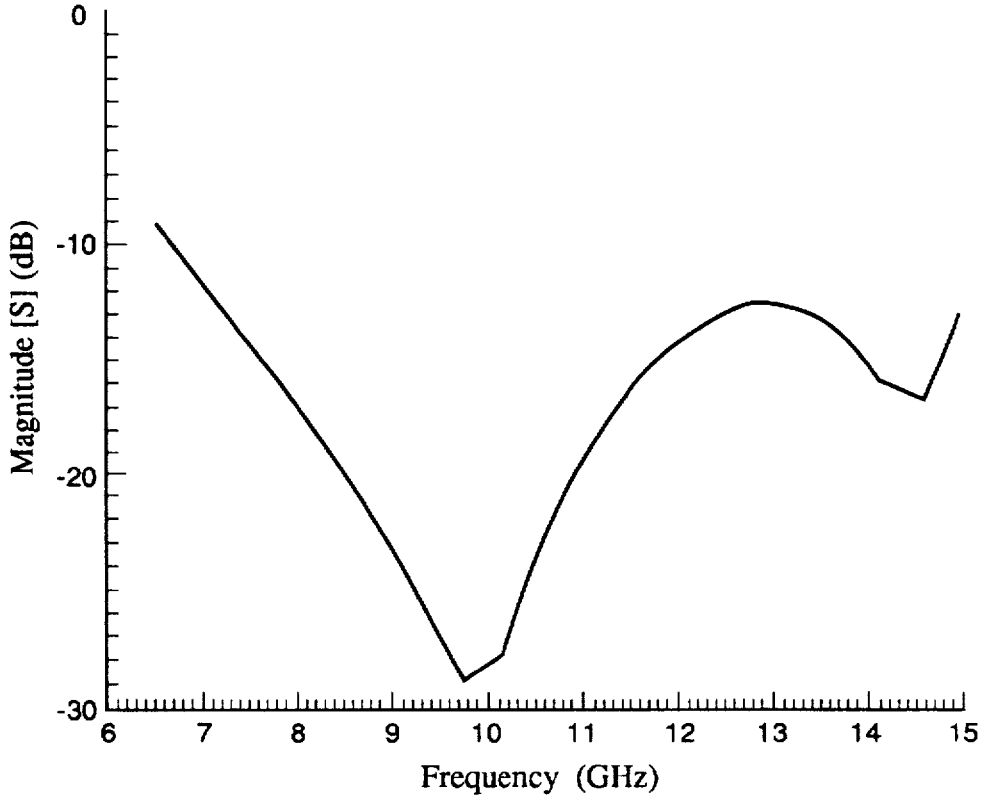
FIG.10

WIDE-BAND/DUAL-BAND STACKED-DISC RADIATORS ON STACKED-DIELECTRIC POSTS PHASED ARRAY ANTENNA

TECHNICAL FIELD OF THE INVENTION

This invention relates to phased array antennas, and more particularly to a wide-band or dual-band array antenna using stacked-disc radiators on stacked cylindrical dielectric posts.

BACKGROUND OF THE INVENTION

There is a need in the ship, submarine, and airborne satellite communication or radar fields for a wide-band or dual-band phased array antenna with dual-linear or circular polarization. In the open literature, there are described some microstrip disc patch array antenna designs, but these designs show very limited capabilities in the bandwidth and/or scan coverage performances. See, "Microstrip Array Technology," Robert J. Mailloux et al., IEEE Antennas and Propagation Transactions, Vol. AP-29, January 1981, pages 25–37. Phased arrays have been developed which use a disc radiator on a dielectric post, but these arrays have limited bandwidth, on the order of 20%.

SUMMARY OF THE INVENTION

A radiator structure for use at microwave frequencies is described, and includes a ground plane, and a lower dielectric post having a lower surface disposed adjacent the ground plane and an upper surface. A thin lower radiator element is disposed on the upper surface of the lower dielectric post. An upper dielectric post having a lower surface and an upper surface is stacked on the lower radiator element. An upper thin radiator element is disposed on the upper surface of the upper dielectric post. The radiator structure further includes a pair of spaced probes in electrical contact with the lower radiator element for exciting the lower radiator. The upper radiator element is not fed by feed probes and is a parasitic radiator element. A feed network supplies first and second excitation signals to respective ones of the probes which are 180 degrees out of phase.

A second pair of excitation probes can be arranged in orthogonal locations relative to locations of the first pair of probes. The feed network further supplies third and fourth excitation signals to respective ones of the second pair of probes which are 180 degrees out of phase with each other.

In a preferred embodiment, the lower and upper dielectric posts have a cylindrical configuration, and are of equal diameter. The lower radiator element is a circular disc of electrically conductive material. In one wide-band embodiment, the upper radiator element is also a circular disc of electrically conductive material. In an alternate embodiment, the upper radiator element is an annular ring of electrically conductive material. Both embodiments can provide wide-band or dual-band performance.

The radiator structure is used in a phased array antenna, wherein a plurality of the radiator structure units are arranged for phased array operation. In one array embodiment, the radiator units are arranged in a rectangular lattice structure. In another array embodiment, the radiator units are arranged in an equilateral triangular lattice configuration.

BRIEF DESCRIPTION OF THE DRAWING

These and other features and advantages of the present invention will become more apparent from the following detailed description of an exemplary embodiment thereof, as illustrated in the accompanying drawings, in which:

FIG. 6 illustrates a feed configuration for dual-band, circular polarization operation.

FIG. 10 illustrates the active return loss as a function of frequency for the E-plane scan case.

DETAILED DESCRIPTION OF THE PREFERRED EMBODIMENTS

Figure 2:
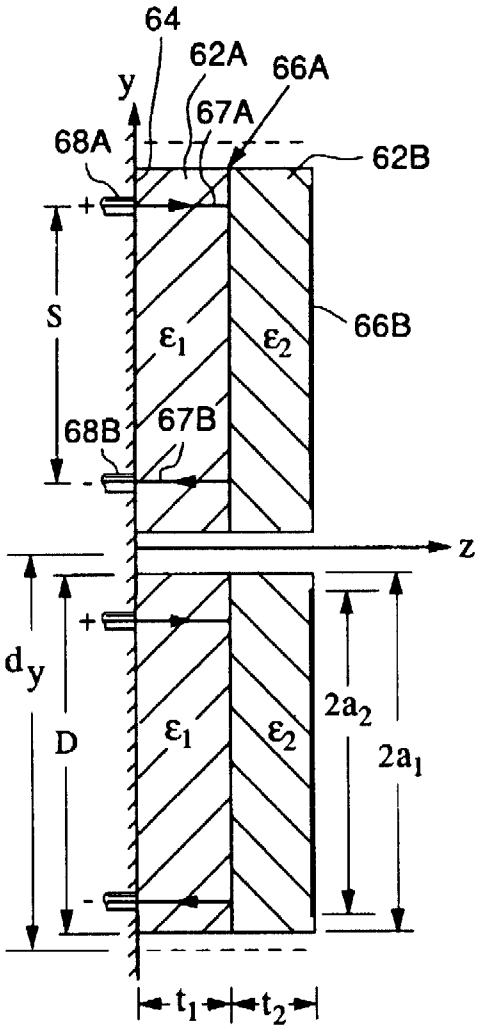
FIG. 2 is a cross-sectional view taken along line 2—2 of FIG. 1.
Figure 1:
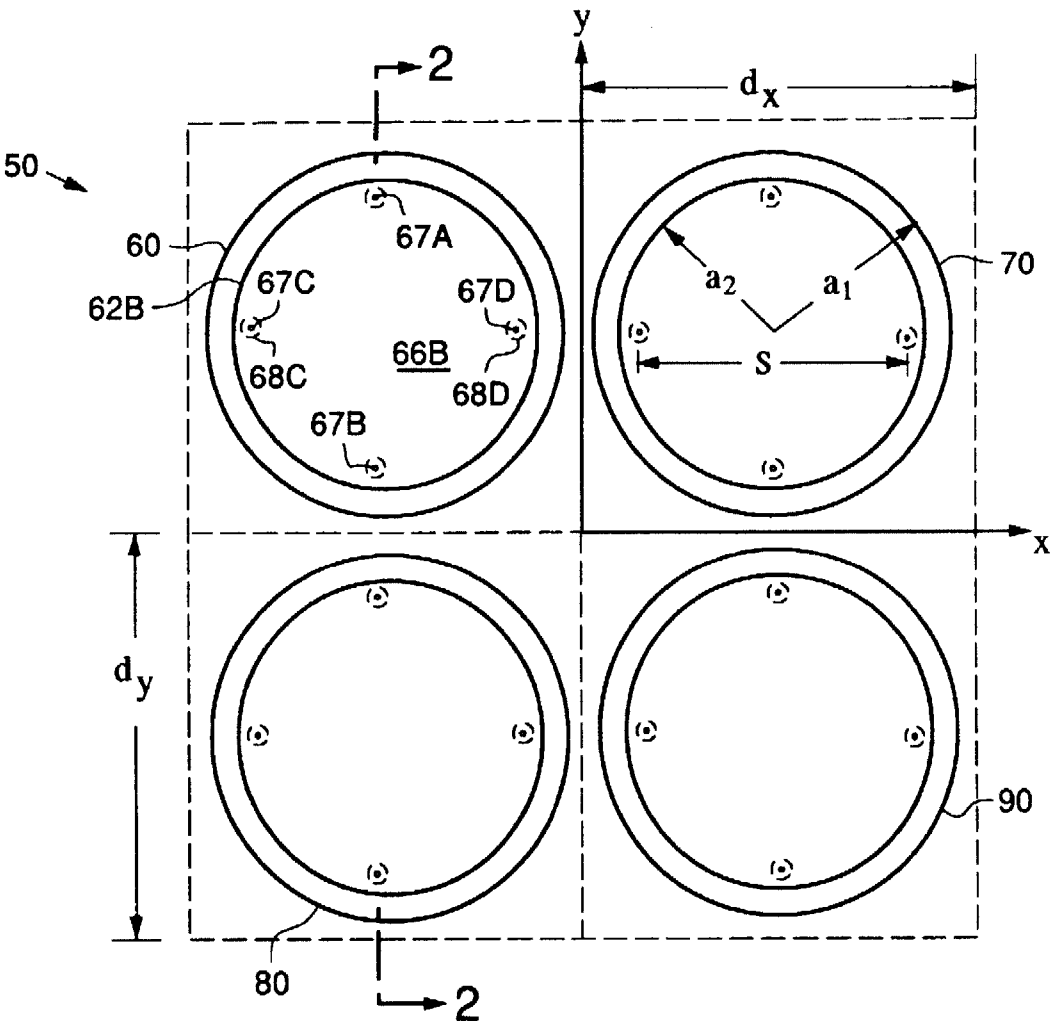
FIG. 1 is a top view of an exemplary embodiment of a stacked-dielectric cylindrical post phased array antenna embodying this invention.
Figure 4:
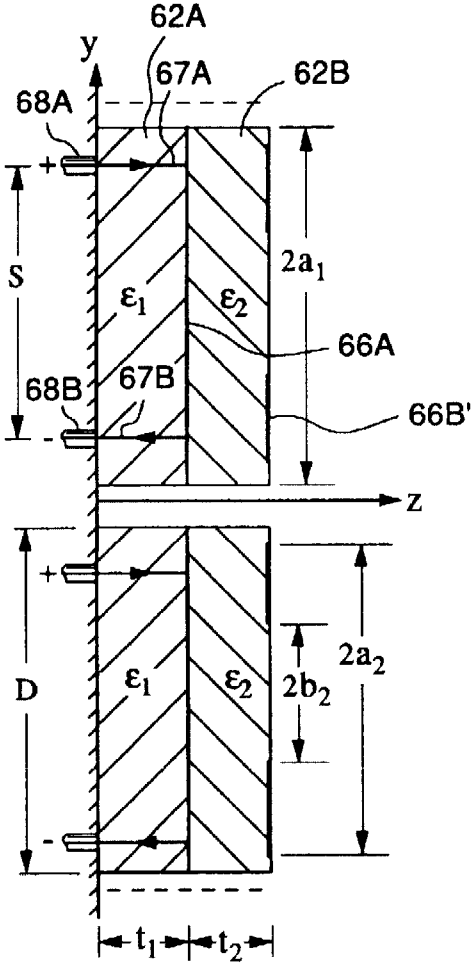
FIG. 4 is a cross-sectional view taken along line 4—4 of FIG. 3.

FIG. 1 is a simplified top view of a portion of an exemplary stacked-dielectric cylindrical post phased array antenna 50 embodying this invention. The portion of the exemplary array 50 shown in FIG. 1 includes four radiating elements or unit cells 60, 70, 80 and 90. Of course, array antennas embodying the invention can include much larger numbers of the radiating elements. The element spacings $d_x$ and $d_y$ are the same and are in rectangular lattice configuration.

The unit cells are identical, and only cell 60 will be described in detail, the other unit cells 70, 80 and 90 being identical to unit cell 60. There are two cylindrical dielectric posts in each unit cell. Thus, cell 60 includes lower dielectric post 62A and upper dielectric post 62B. Both dielectric posts 62A, 62B have the same diameter D. The lower dielectric post 62A is fabricated from a material having a high dielectric constant $\epsilon_1$ and a height $t_1$, and is disposed on the ground plane 64. An exemplary material suitable for the lower disc is "Stycast Hi-K" dielectric material marketed by Emerson and Cuming.

Positioned on top of the lower post 62A is the first disc radiator 66A of radius $a_1$. This disc radiator is excited by two pairs of probes, 67A–67B and 67C–67D arranged in orthogonal locations. The probe separation is S for each pair. Each pair of probes is fed by a pair of coaxial cables 68A–68B and 68C–68D, with 180 degree phase reversal.

The upper dielectric post 62B is fabricated of a material having a low dielectric constant $\epsilon_2$ and a height $t_2$, and is disposed on top of the first disc radiator 66A. A material suitable for use as the upper dielectric post is a low density dielectric foam, such as "Stycast Lo-K" material marketed by Emerson and Cuming. A second disc radiator 66B of radius $a_2$ is in turn positioned on top of the second dielectric post 62B. This upper disc radiator is a parasitic radiator without feeding probes. The parasitic radiator 66B is for tuning to high-band frequencies so that the entire bandwidth is extended from low-band to high-band.

The two pairs of excitation probes 67A–67B and 67C–67D provide dual-linear polarization and circular polarization capability. The pairs of probes (for example, vertical polarization and horizontal polarization) are orthogonal to one another. Consequently, they produce orthogonal polarizations. Two orthogonal linear polarizations can be combined to produce circular polarization.

The lower radiator element is tuned for operation (has a resonance) at a lower frequency. The upper radiator element is tuned for operation at (has a resonance) at a higher frequency. Wide-band performance is obtained by tuning the upper radiator element so that its resonance is close in frequency to that of the lower radiator element. Dual-band operation is achieved when the resonances of the lower and upper radiator elements are separated in frequency sufficiently to form distinct frequency bands, with relatively poor performance at frequencies intermediate the two bands.

Figure 3:
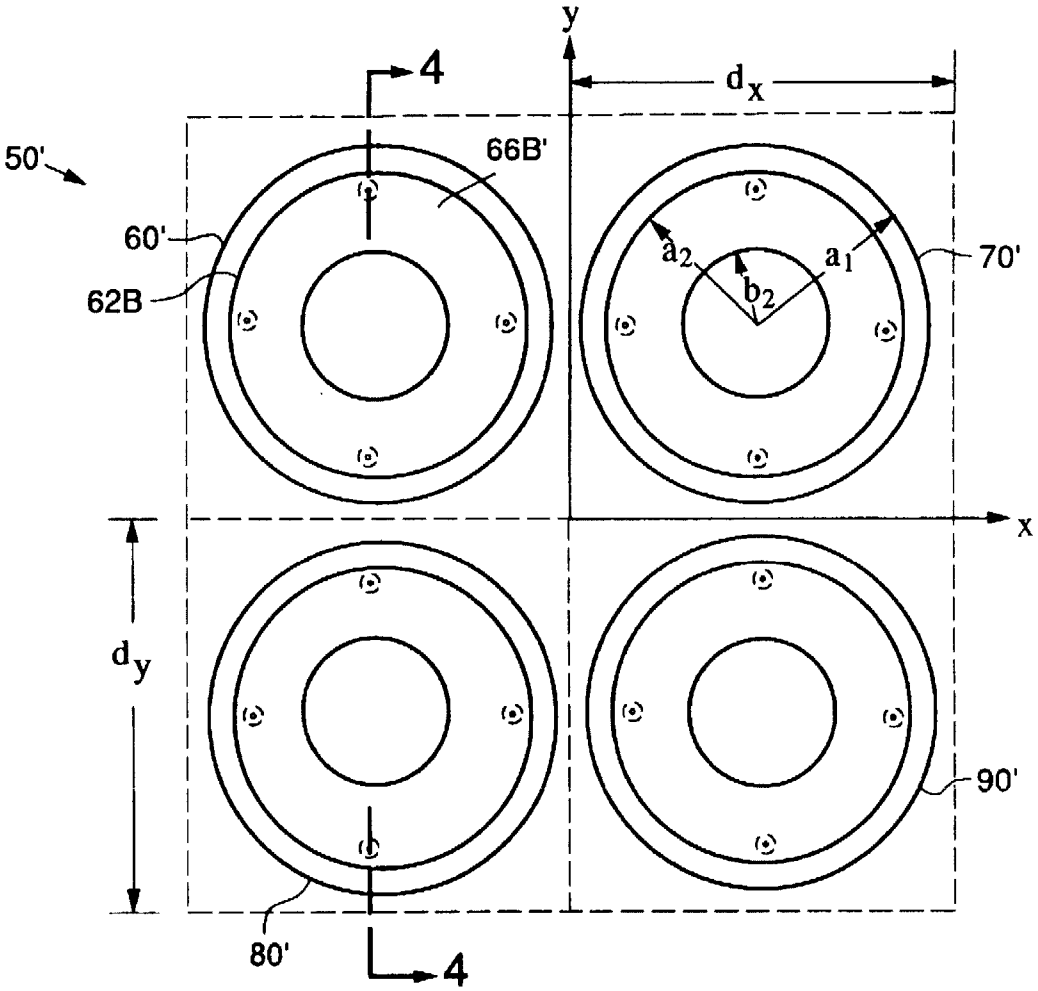
FIG. 3 illustrates an alternate embodiment of the invention, wherein the top disc radiator of FIG. 1 is replaced with an annular ring radiator.

FIG. 3 illustrates an alternate embodiment of the invention, wherein the top disc radiator 66B of the embodiment of FIG. 1 is replaced with an annular ring radiator. Thus, the array system 50' of FIG. 3 employs an annular ring radiator 66B'; the annular ring radiator is also a parasitic radiator without feeding probes. The annular ring radiator has an inner circumference of radius $b_2$ and an outer circumference of radius $a_2$. This annular ring parasitic radiator 66B' provides a different frequency tuning effect than that of the solid disc radiator 66B.

Figure 5:
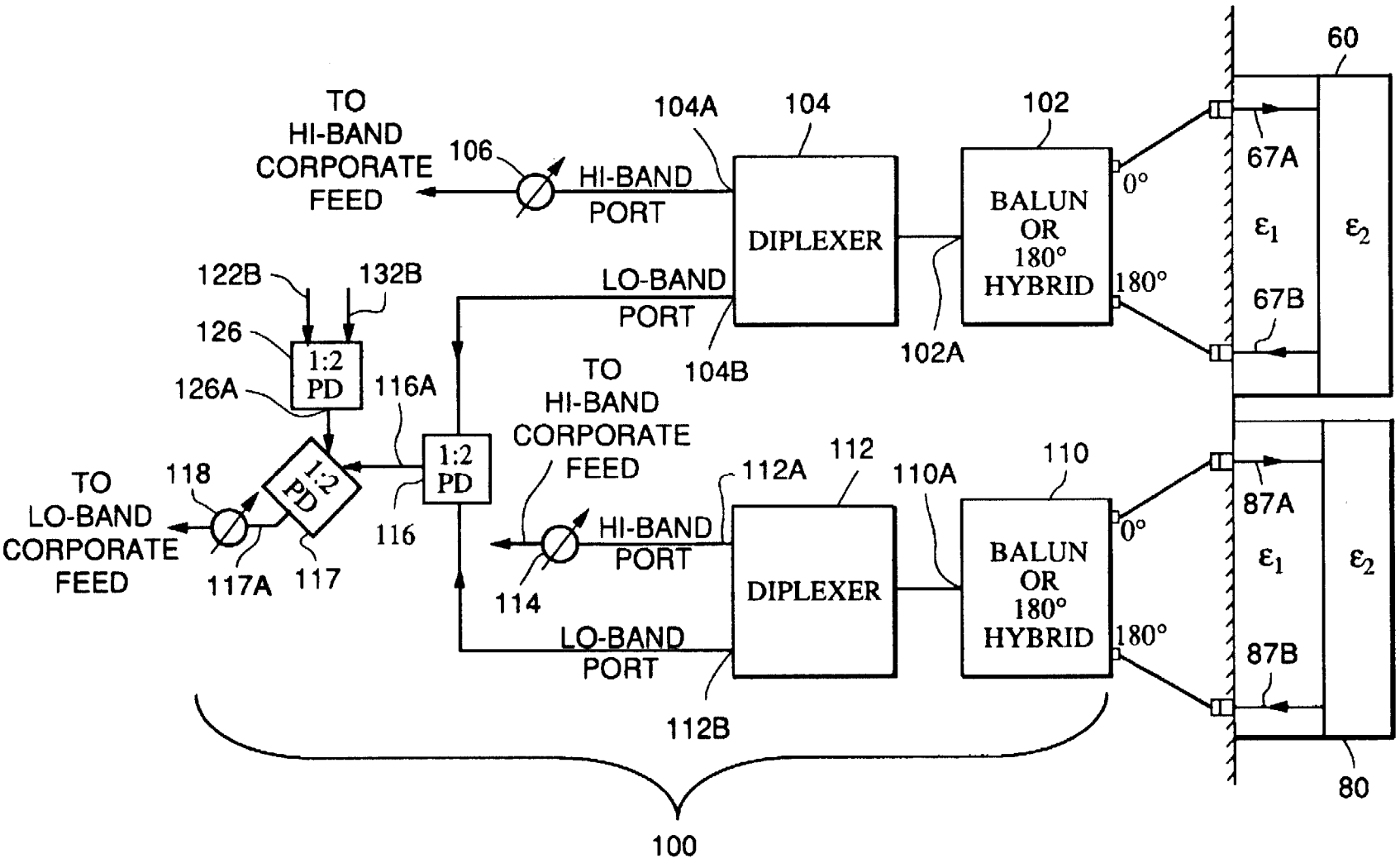
FIG. 5 illustrates a feed configuration for one linear-polarization dual-band operation.

FIG. 5 illustrates a feed configuration 100 for one exemplary linear-polarization dual-band operation. One pair of the feed probes of each element is fed by a 180 degree phase reversal device. Thus, the feed probes 67A–67B of exemplary element 60 are fed by a 180 degree phase reversal (equal power) balun or 180 degree (equal power) hybrid 102. The feed probes 87A–87B of adjacent element 80 are fed by a 180 degree phase reversal balun or 180 degree hybrid 110. The input port 102A of the feed balun is connected to a diplexer 104. Two output ports of the diplexer 104 are the high-band port 104A and the low-band port 104B. Similarly, the input port 110A of the feed balun 110 is connected to a diplexer 112. Two output ports of the diplexer 112 are the high-band port 112A and the low-band port 112B. Each high-band port is connected to a high-band phase shifter and then to the high-band corporate feed network. Thus, port 104A is connected to high-band phase shifter 106 and then to the high-band corporate feed network. Port 112A is connected to high-band phase shifter 114 and then to the high-band corporate feed network. Two low-band ports from two adjacent elements in the azimuth direction and two in the elevation direction are combined (to reduce the component count), and these azimuth and elevation ports are further combined into one output. For example, low-band ports 104B and 112B are combined at combiner 116 to form an azimuth signal at port 116A. The low-band ports 122B and 132B from other adjacent elements (not shown in FIG. 5) are combined at combiner 126 to form an elevation signal at port 126A. Outputs 116A and 126A are combined at combiner 117 to produce output 117A. This output 117A is then connected to low-band phase shifter 118 and further connected to a low-band corporate feed network. A similar circuit can be made to excite the orthogonal linear polarization probes of the radiating elements to obtain dual linear polarization operation.

The feed configuration 100 can be modified from dual-band to wide-band operation by removing the diplexers 104 and 112, and combiners 116, 117, 126, so that the respective balun outputs are connected directly to respective (wide band, in this case) phase shifters.

FIG. 6 illustrates a feed configuration 150 for dual-band, circular polarization operation. The four probes of each disc radiator need to be excited in phase sequence as shown in FIG. 6. This can be achieved by feeding two orthogonal pairs by two 180 degree hybrids and combing the outputs with a 90 degree hybrid circuit. Consider the example of disc radiator 66A of element 60, fed by probe pairs 67A–67B and 67C–67D. The probe 67A is to be fed with a feed signal of 90 degrees relative phase, the probe 67B with a feed signal of 270 degrees relative phase, the probe 67C with a feed signal of 180 degrees relative phase, and the probe 67D with a feed signal of 0 degrees relative phase. The feed configuration 150 comprises 180 degree hybrids 152 and 154, 90 degree hybrid 156, and diplexer 158 with high-band input port 158A, low-band port 158B and input/output port 158C. The feed configuration 150 can be modified to wide-band operation by removing the diplexer 158. For a wide-band transmit operation, the signal at 158C is divided (equally)in power by hybrid 156, and the signal at port 156B of 90 degrees phase relative to the signal at 156A. The signal at 156A is divided in power at hybrid 154, with the signal at port 154B at 180 degrees phase relative to the signal at 154A. The signal at 156B is divided in power at hybrid 152, with the signal at port 152B of 180 degrees phase relative to the signal at 152A. As a result, the signal at port 152A is at 90 degrees phase relative to the signal at port 154A. The ports of the 180 degree hybrids are connected to corresponding probes by equal length coaxial cables. Thus, the desired phasing of the feed signals is achieved.

Figure 7:
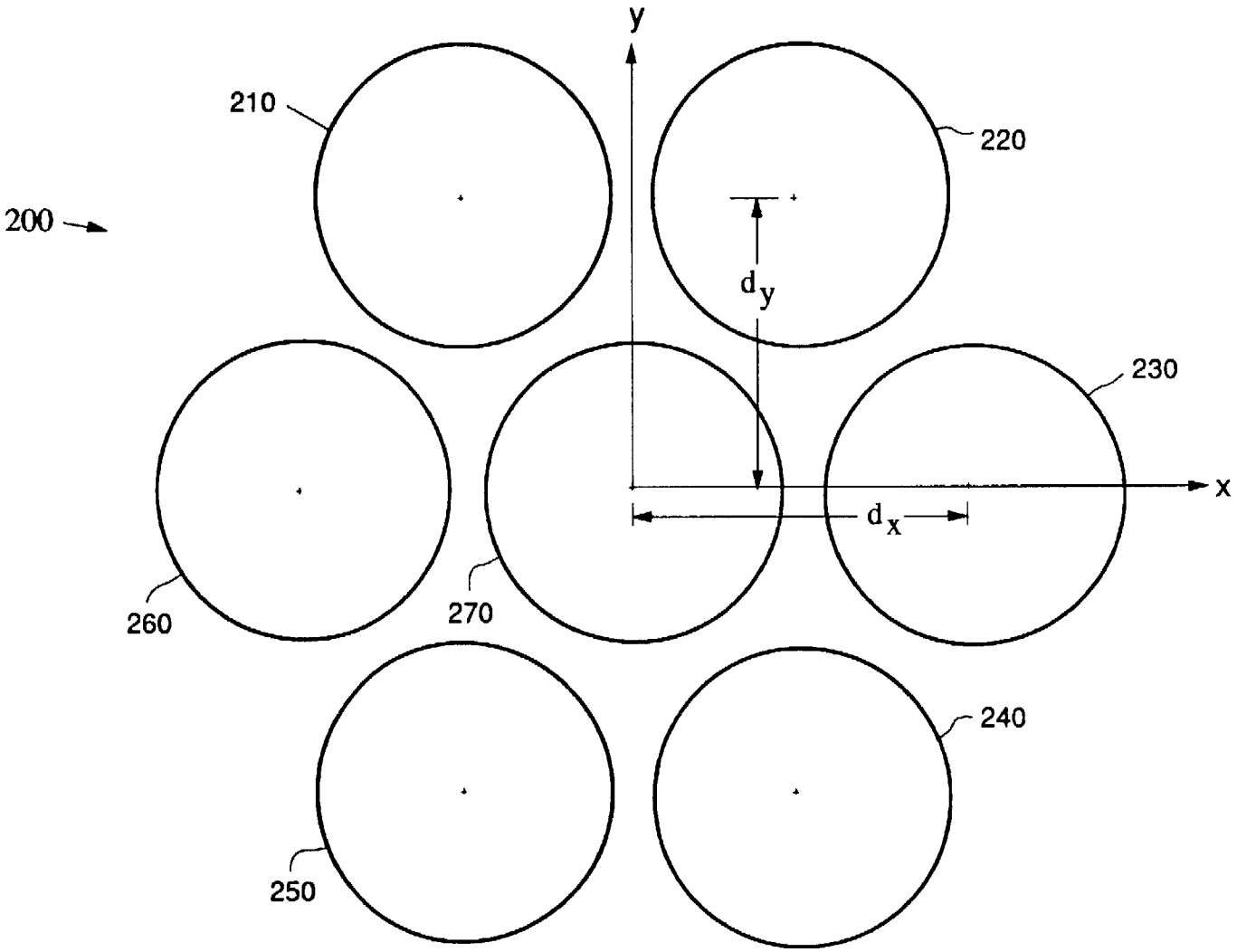
FIG. 7 shows the phased array arranged in equilateral triangular lattice structure.

FIG. 7 shows a phased array 200 embodying the invention, and arranged in equilateral triangular lattice structure. This will improve some scan performance in the principal plane cuts. The array 200 includes seven exemplary unit cells 210–270 of the stacked-disc radiators on stacked-dielectric posts, with cells 210–260 arranged about a center cell 270.

An example of the design for linear polarization with single-pair probe excitation in accordance with this invention is given as follows:

$d_x=d_y=0.3278$ inches in rectangular lattice, the dielectric post diameter D=0.3105 inches;

the lower dielectric post $t_1=0.0800$ inches and dielectric constant $\epsilon_2=6.50$;

the upper dielectric post $t_2=0.0828$ inches and dielectric constant $\epsilon_2=1.4$;

the lower disc radiator $a_1=0.138$ inches, and the probe separation S=0.1656 inches;

the upper disc radiator $a_2=0.1311$ inches.

Figure 8:
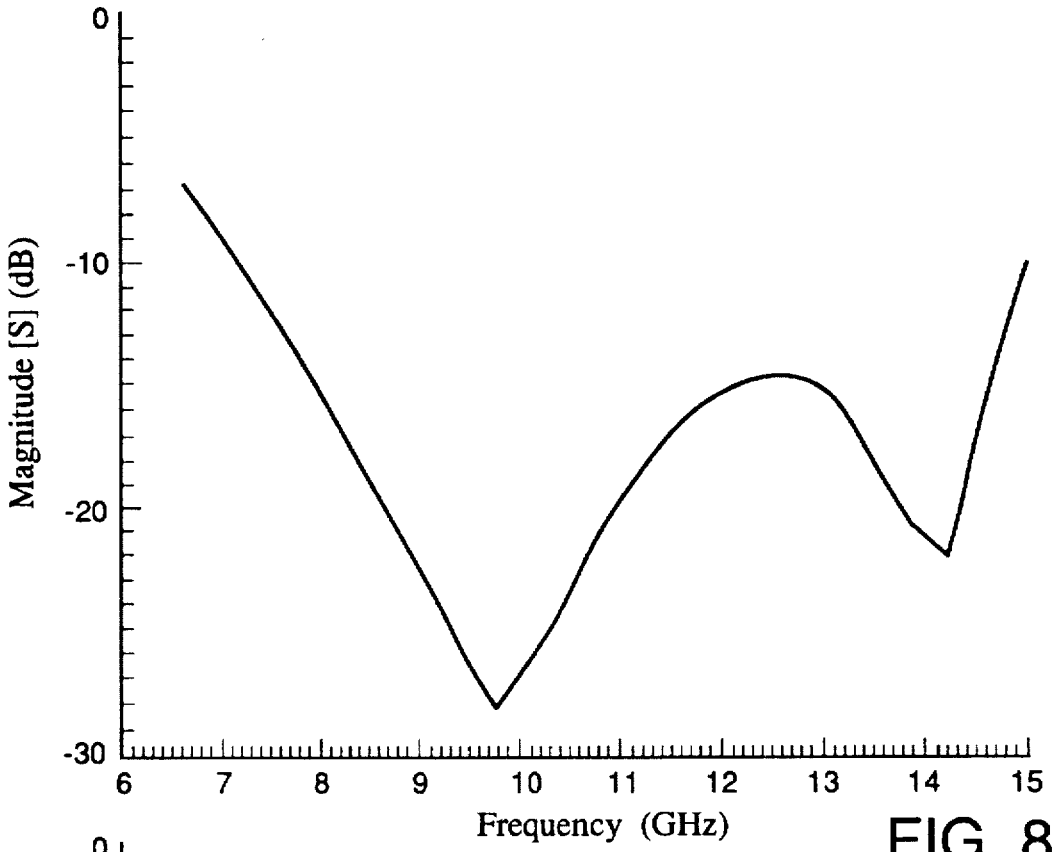
FIG. 8 illustrates the computed active return loss as a function of frequency for broadside scan.
Figure 9:
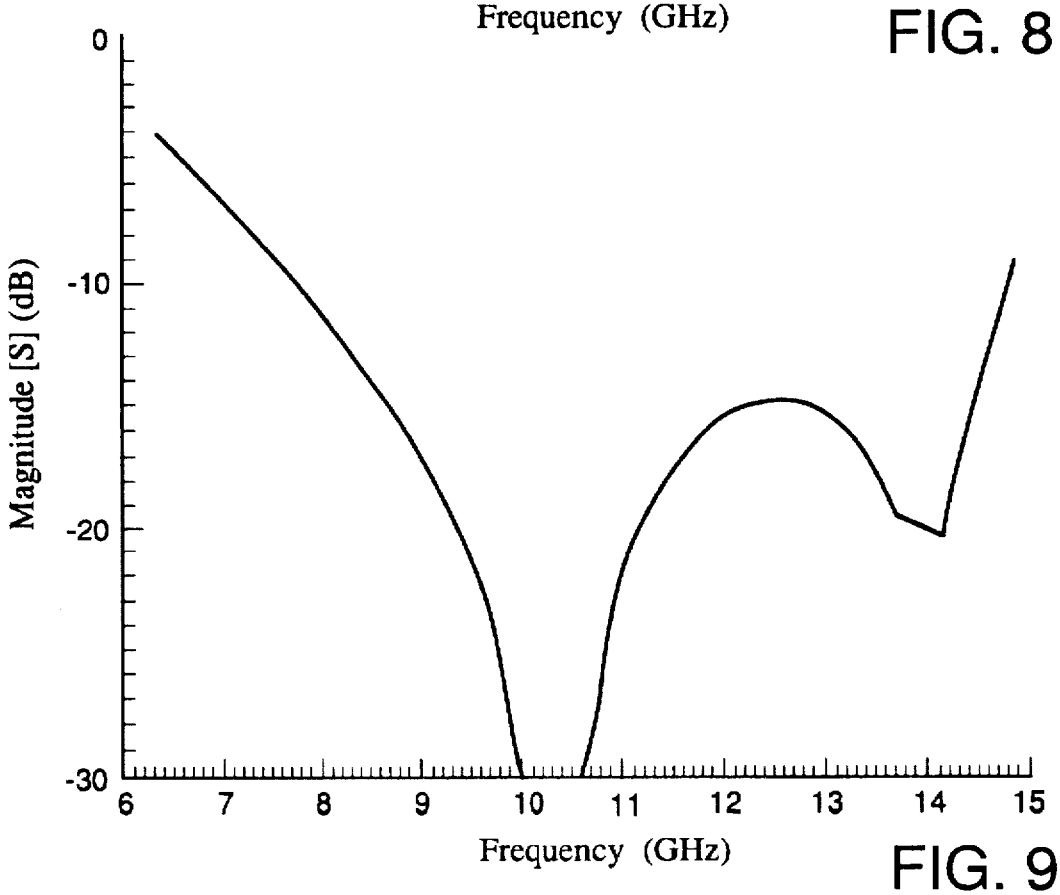
FIG. 9 illustrates the active return loss as a function of frequency for the H-plane scan case.

The computed active return loss for this exemplary linear polarization example as a function of frequency for broadside scan (θ=0 degrees scan) is given in FIG. 8. The active return loss is below −10 dB for the frequency band from 7 GHz to 15 GHz. FIG. 9 illustrates the input active return loss as a function of frequency for H-plane scan case (at f=7 GHz, scan=40 degrees; at f=15 GHz, scan=17.5 degrees). For the E-plane scan case (scan=40 degrees at f=7 GHz; scan=17.5 degrees at f=15 degrees), the input active return loss as a function of frequency is given in FIG. 10.

There has been described a very wide-band or dual-band phased array antenna system using stacked-disc radiators on stacked-dielectric cylindrical posts. The polarization of the array can be single-linear, dual-linear, or circular polarization depending on whether using single-pair or double-pairs of probe excitations. The array is low-profile, compact and rigid, and its bandwidth in exemplary applications can be 2:1 over a wide scan volume. While the exemplary embodiments illustrated herein have employed cylindrical dielectric posts and circular disc elements, other configurations can be used, depending on the application. These other configurations include, but are not limited to, elliptical or rectangular cross-sectional configurations for the posts and radiator conductor elements. Further, while the disclosed embodiments have employed two radiator elements stacked with two dielectric posts, one or more additional radiator element/dielectric posts can be added to each unit radiating cell to achieve even higher bandwidth.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A phased array antenna comprising a plurality of radiator units arranged in a spaced configuration for radiating energy into free space, and wherein said radiator units each comprise:

a ground plane;

a discrete lower dielectric post having a lower surface disposed adjacent the ground plane and an upper surface, said lower dielectric post fabricated of a high dielectric material;

a discrete thin lower radiator element disposed on said upper surface of said lower dielectric post;

a discrete upper dielectric post having a lower surface and an upper surface, said upper dielectric post stacked on said lower radiator element, said upper dielectric post fabricated of a low dielectric material;

a discrete upper thin radiator element disposed on said upper surface of said upper dielectric post; and a first pair of spaced probes in electrical contact with said lower radiator element for exciting the lower radiator, wherein the upper radiator element is not fed by feed probes and is a parasitic radiator element, and wherein the radiator structure is not surrounded by waveguide walls or cavity walls, and the radiator structure provides a radiator element suitable for wide-band operation for radiating energy into free space.

2. The phased array antenna of claim 1 wherein said spaced configuration is a rectangular lattice structure.

3. The phased array antenna of claim 1 wherein said spaced configuration is an equilateral triangular lattice structure.

4. The phased array antenna of claim 1 wherein said lower and upper dielectric posts have a cylindrical configuration, and are of equal diameter.

5. The phased array antenna of claim 1 wherein said lower radiator element is a circular disc of electrically conductive material.

6. The phased array antenna of claim 1 further comprising a feed network for supplying first and second excitation signals to respective ones of said probes, said excitation signals 180 degrees out of phase.

7. The phased array antenna of claim 1 further comprising a second pair of excitation probes arranged in orthogonal locations relative to locations of said first pair of probes.

8. The phased array antenna of claim 7 further comprising a feed network for supplying first and second excitation signals to respective ones of said first pair of probes, said first and second excitation signals 180 degrees out of phase, and for supplying third and fourth excitation signals to respective ones of said second pair of probes, said third and fourth excitation signals 180 degrees out of phase with each other.

9. The phased array antenna of claim 8 wherein said first and second excitation signals produce a first linear polarization excitation, and said third and fourth excitation signals produce a second linear polarization which is orthogonal to said first linear polarization excitation.

10. The phased array antenna of claims 9 wherein said respective feed signals are phased to provide circular polarization operation.

11. The phased array antenna of claim 1 wherein said upper radiator element is an annular ring of electrically conductive material.

* * * * *